US005527383A

United States Patent [19]

Flynn et al.

[11] Patent Number: 5,527,383

[45] Date of Patent: Jun. 18, 1996

[54] LUBRICANT ADDITIVES FOR PAPER COATING COMPOSITIONS

[75] Inventors: Gregory J. Flynn, Pineville; John M. Krasniewski, Charlotte, both of N.C.; Joseph Wilson, Jr., Lake Wylie, S.C.

[73] Assignee: Henkel Corporation, Plymouth Meeting, Pa.

[21] Appl. No.: 322,901

[22] Filed: Oct. 13, 1994

[51] Int. Cl.[6] ..... C08L 91/00

[52] U.S. Cl. ..... 106/243

[58] Field of Search ..... 106/243

[56] References Cited

U.S. PATENT DOCUMENTS 2,425,828 8/1947 Retzch et al. ..... 106/243

4,659,489 4/1987 Hill et al. ..... 252/40.5

4,676,836 6/1987 Hill et al. ..... 106/243

*Primary Examiner*—David Brunsman

*Attorney, Agent, or Firm*—Ernest G. Szoke; Wayne C. Jaeschke; Real J. Grandmaison

[57] ABSTRACT

Aqueous lubricant dispersions having a solids content of from about 45% by weight to about 75% by weight contain calcium stearate and a lubricant component with or without a dispersing agent or urea for addition to aqueous paper and paperboard coating compositions.

9 Claims, No Drawings

LUBRICANT ADDITIVES FOR PAPER COATING COMPOSITIONS

BACKGROUND OF THE INVENTION

1. Field of the Invention

This invention relates to fatty acid metal soap aqueous dispersion blends as paper coating lubricant additives for use in paper coating mixtures for coating moving paper and paper board webs.

2. Discussion of Related Art

Calcium stearate, a water-insoluble metal soap, is a recognized component of paper coating compositions. It contributes lubricating, leveling and anti-dusting properties to paper coating compositions which contain primarily pigment, adhesive and lubricant in an aqueous system.

Where the lubricant is calcium stearate, a water-insoluble soap, it is generally supplied as an aqueous dispersion which can be introduced along with the other components in the preparation of the paper coating. Such dispersion contains at most 50 to 55% by weight solids including calcium stearate and dispersing agent. Attempts to increase calcium stearate content result in formation of a paste. Further, when the calcium stearate dispersion is prepared by the in-situ method, at most, 55% by weight solids is obtained.

U.S. Pat. No. 2,425,828 to Retzsch et al., Aug. 19, 1947, discloses the preparation of dispersions of metal soaps including calcium stearate using polyethylene glycol monoesters of fatty acids as dispersing agents. In the examples, dispersions of 40% calcium stearate, 10% dispersing agent and 50% water (50% total solids) are disclosed.

U.S. Pat. No. 4,659,489 describes aqueous lubricant dispersions used in the preparation of paper and paperboard coating compositions. These dispersions have a solids content of about 50% by weight to about 75% by weight comprising calcium stearate, dispersing agent for same, nonionic lubricant and urea. The nonionic lubricant is selected from the group consisting of polyalkylene glycol mono and di esters of fatty acids, ethylene oxide adducts of fatty amides, ethylene oxide adducts of fatty alcohols, lower alkyl mono ethers of ethylene oxide-propylene oxide random or block copolymers, sorbitan esters of fatty acids, ethylene oxide and propylene oxide adducts of sorbitan esters of fatty acids, lower alkyl mono ethers of polyethylene glycol mono esters of fatty acids, and ethylene oxide-propylene oxide random or block copolymers.

U.S. Pat. No. 4,676,836 discloses aqueous lubricant dispersions having a solids content of from about 50% by weight to about 75% by weight containing calcium stearate, dispersing agent, anionic lubricant and urea characterized by increased solids content. The anionic lubricant may be a water-soluble ammonium, substituted ammonium or alkali metal salt of (a) sulfated fatty acid esters, (b) fatty acid soaps, (c) sulfated fatty acids, (d) linear alkyl aryl sulfonates, (e) ethoxy sulfates, (f) alcohol sulfates, (g) sulfated castor oil ethoxylates, (h) phosphate esters of alkyl phenol ethoxylates, (i) sulfated alkyl aryl ethoxylates, (j) alpha olefin sulfonates, (k) sulfonated alkyl phenol ethoxylates, (l) bis alkyl sulfosuccinates, and (m) sulfated glycerides of unsaturated fatty acids.

The art, however, is still seeking improved calcium stearate dispersions of enhanced solids content. The advantages of such are reduced shipping costs since less water is shipped. Also, when added to the coating composition, less water is introduced meaning less energy is required to remove the same during the drying operation.

Further, improvements in coater runnability with increased precision during coating application and metering while coating a rapidly moving web of paper or paper board with a mineral-containing coating mixture is always sought. In addition, low viscosity increases in starch-containing paper coatings are very desirable. Still further, improved leveling properties and finished paper sheet optical properties such as sheet gloss, brightness and opacity after calendering are constant objectives in this art.

3. Description of the Invention

Other than in the operating examples, or where otherwise indicated, all numbers expressing quantities of ingredients or reaction conditions used herein are to be understood as modified in all instances by the term "about".

In accordance with this invention, aqueous lubricant dispersions for addition to aqueous paper and paperboard coating compositions having a solids content of from about 45% by weight to about 75% by weight, preferably from about 50% by weight to about 75% by weight, are provided.

In one embodiment of the invention, the solids content of the lubricant dispersions comprises (1) a fatty acid metal soap, (2) a calcium stearate dispersant, (3) a block copolymer containing alkoxylated glycerine and having a molecular weight of about 2,000–6,000, and (4) urea. The fatty acid metal soap is preferably calcium stearate; and the alkylene oxide source in the alkoxylated glycerine block copolymer is preferably ethylene oxide and/or propylene oxide.

In another embodiment of this invention, the solids content of the lubricant dispersions comprises a mixture of (1) a fatty acid metal soap such as calcium stearate, and (2) a fatty acid ester of polyethylene glycol in a weight ratio of about 1:0.05 to 5.00.

In a further embodiment of this invention, the solids content of the lubricant dispersions comprises a mixture of (1) a fatty acid metal soap such as calcium stearate, and (2) a glycerin polymer alkoxylated with ethylene oxide and/or propylene oxide having a molecular weight of at least about 2,000 to 6,000 in a weight ratio of about 1:0.05 to 5.00.

In a still further embodiment of this invention, the solids content of the lubricant dispersions comprises a mixture of (1) a fatty acid metal soap such as calcium stearate, and (2) a sulfonated fatty acid ester in a weight ratio of about 1:0.05 to 5.00.

Thus, additional lubricant compositions containing enhanced total solids content have been developed. These compositions, despite reduced calcium stearate content, are as effective as lubricants as prior art calcium stearate dispersions containing less total solids content but greater calcium stearate content.

It was most unexpected to find that the aforementioned combinations with calcium stearate form high solids content products which function equally to or better than calcium stearate lubricants and which have a workable viscosity.

4. Description of Preferred Embodiments

As earlier indicated, the aqueous lubricant dispersions of this invention contain from about 45% by weight to about 75% by weight, preferably from about 50% by weight to about 75% by weight solids, the remaining component being water. The solids content of the lubricant dispersions comprises the following ratios:

| component | parts by weight |
|---|---|
| calcium stearate | 1.00 |
| dispersing agent for calcium stearate | 0 to about 0.10 |
| lubricant | about 0.05 to about 5.00 |
| urea | 0 to about 1.00 |

Generally speaking, useful viscosities of these lubricant dispersions may range up to about 500 cps as determined with a Brookfield viscosimeter at 100 rpm and at 22° C.

Calcium stearate is a well known article of commerce and its use in dispersions is well known. Any calcium stearate useful in paper coating compositions is useful herein. Depending upon the grade of stearic acid used in its preparation, there will be present other fatty material such as palmitic and oleic acid. Thus, the term calcium stearate covers calcium stearate as well as calcium stearate containing varying amounts of calcium palmitate, calcium oleate and other materials.

The dispersing agents can be those which are known to disperse calcium stearate in water. Useful dispersing agents are those described in U.S. Pat. No. 2,425,828 such as polyethylene glycol monoesters of fatty acids. Generally, the polyethylene glycol should have a molecular weight of 200 or above such as polyethylene glycols having molecular weights of 200, 300 and 400.

The fatty acids which may be esterified by these glycols may be any fatty acid having from 10 to 24 carbon atoms, such as lauric acid, oleic acid and stearic acid, as well as mixtures of acids obtained from natural glycerides such as mustard seed oil, coconut oil and other naturally occurring oils as well as the glycerides themselves.

Specific examples of dispersing agent are the monoesters of the reaction product of polyethylene glycol 400 and mustard seed oil as described in Example I of U.S. Pat. No. 2,425,828 and the reaction product of polyethylene glycol 400 and coconut fatty acids as described in Example II of U.S. Pat. No. 2,425,828.

Other useful dispersing agents include polyoxyethylene adducts of alkylated phenols. Generally, the alkyl group contains from 8 to 16 carbon atoms such as in octyl phenol, nonyl phenol and dodecyl phenol and can be straight or branched chain. The alkylated phenol can be reacted with from about 6 to about 15 moles of ethylene oxide. Examples include octyl phenol reacted with 9 moles of ethylene oxide and dodecyl phenol reacted with 12 moles of ethylene oxide. Also, ethoxylated alcohols such as the adduct of tridecyl alcohol and six moles of ethylene oxide can be used. However, a dispersing agent per se is not necessary with some of the aqueous lubricant dispersion compositions of this invention.

The lubricant component employed with a fatty acid metal soap such as calcium stearate to form the aqueous lubricant dispersions of this invention may be one or a mixture of particular water-soluble lubricants. Thus, the lubricant component may be selected from a block copolymer containing alkoxylated glycerine and having a molecular weight of from about 2,000 to about 6,000, preferably from about 3,500 to about 4,000. Examples of such a block copolymer include ethylene oxide, propylene oxide reacted with 1, 2, 3-propanetriol. In addition, the lubricant component may be selected from a fatty acid ester of polyethylene glycol. The polyethylene glycol fatty acid ester may be selected from a polyethylene glycol ester of a fatty acid such as coconut fatty acid, rapeseed oil, tallow fatty acid, fish fatty acid, tall oil fatty acid or palm oil. The polyethylene glycol fatty acid ester may have a molecular weight of from about 500 to about 1,000, preferably from about 520 to about 720 because such materials exhibit both dispersion and lubrication properties.

Further, the lubricant component may be a sulfonated fatty acid ester of $C_{12}$ to $C_{22}$ fatty acids such as sulfonated butyl oleate, sodium salt, including ammonium, substituted ammonium and alkali metal sulfonates. Examples of such a lubricant component include sulfonated butyl stearate, Na salt; sulfonated butyl laurate, Na salt; sulfonated butyl myristate, Na salt and the like.

Where substituted ammonium salts are used, they are derived from mono, di and tri lower alkanolamines such as monoethanolamine, diethanolamine, triethanolamine and mixed isopropanolamines and methyl amines such as methyl and dimethyl amine.

The preparation of these aqueous lubricant dispersions may be carried out in the following manner. Dry particulate calcium stearate is dispersed in water with or without a dispersing agent per se. Where a dispersing agent is employed, generally from about 0.01 to about 0.10 parts by weight of dispersing agent per 1.00 part by weight of calcium stearate is employed. Thereafter, the aforementioned lubricant component(s) and urea, if desired, are added to the dispersion and mixed.

At this time, it can be seen that the starting point of this invention can be, if desired, the conventional calcium stearate dispersions containing no more than 55% by weight of solids. They are prepared by reacting stearic acid or fatty acid mixture containing stearic acid with a calcium containing material such as calcium hydroxide in the presence of water with or without dispersant using thorough mixing. The preparation of these dispersions is well known and the use of same herein is not limited to any particular calcium stearate, or any particular dispersing agent.

To the calcium stearate dispersion, regardless of its source, there is added from about 0.05 part by weight to about 5.00 parts by weight lubricant component per 1.00 part by weight of calcium stearate and, if desired, urea in amounts of from about 0.01 to about 1.00 part by weight per 1.00 part by weight of calcium stearate in any order or together.

The paper coating compositions to which the high solids lubricant dispersions are added are well known and the addition of the high solids lubricant dispersion is not limited to any particular coating composition.

The coating compositions contain in addition to a lubricant both pigment and binder (adhesive), and optionally, insolubilizer, all in an aqueous system. Typical pigments are clay (Kaolin), calcium carbonate, satin white, talc, titanium dioxide, zinc oxide and blanc fixe, while typical binders are starch, such as ethylated and oxidized starch, protein such as soya protein and casein, and synthetic resins such as butadiene styrene latex such as a 60/40 styrene/butadiene copolymer and polyvinyl acetate-acrylic copolymer.

Examples of insolubilizer are melamine-formaldehyde resin and glyoxal-urea reaction product.

The starch is generally cooked in water, then added to a dispersion of the pigment. Thereafter, the high solids calcium stearate lubricant is introduced. Based on 100 parts by weight pigment, there is used from about 10 to about 25 parts by weight binder and from about 0.5 to about 1.5 parts by weight of lubricant solids. Optionally, there can be used from about 0.4 to about 2.5 parts by weight of insolubilizer.

The solids content of the coating composition may vary from about 30% by weight to about 70% by weight, the remainder being water.

The coating compositions containing the high solids lubricant are applied to paper and paperboard by conventional methods which include the steps of applying the coating compositions to the paper or the paperboard, smoothing, drying and calendering or supercalendering.

For a fuller understanding of this invention, reference may be made to the following examples. These examples are given merely to illustrate the invention and are not to be construed in a limiting sense.

Examples I through IV describe the aqueous lubricant dispersions of this invention. All were prepared according to the following general procedure.

A 50% by weight calcium stearate dispersion was placed in a laboratory mixer. Additional water as required was added, followed by addition of lubricant as aqueous solutions. Mixing was carried out until a homogeneous dispersion was formed. Viscosities were determined for the compositions of each example using a Brookfield Viscometer at 100 rpm. Total water content including water introduced with the calcium searate dispersion and with the lubricant is given.

EXAMPLE I

| component | parts by weight |
|---|---|
| calcium stearate | 26.2 |
| condensates of nonylphenol and 10 moles ethylene oxide | 1.1 |
| block copolymer containing alkoxylated glycerine, m.w. 3900 | 25.6 |
| urea | 17.1 |
| water | 30.0 |
| viscosity = 450 cps/25° C./100 RPM #3 spindle | |

EXAMPLE II

| component | parts by weight |
|---|---|
| calcium stearate | 20.0 |
| condensates of nonylphenol and 10 moles ethylene oxide | 1.1 |
| polyethylene glycol coconut fatty acid ester (PEG 400) | 30.0 |
| water | 48.9 |
| viscosity = 250 cps/25° C./100 RPM #3 spindle | |

EXAMPLE III

| component | parts by weight |
|---|---|
| calcium stearate | 20.0 |
| condensates of nonylphenol and 10 moles ethylene oxide | 1.1 |
| glycerin polymer alkoxylated with ethylene oxide and propylene oxide, M.W. 3900 | 30.0 |
| water | 48.9 |
| viscosity = 450 cps/25° C./100 RPM #3 spindle | |

EXAMPLE IV

| component | parts by weight |
|---|---|
| calcium stearate | 30.25 |
| condensates of nonylphenol and 10 moles ethylene oxide | 1.10 |
| sulfonated butyl ester of oleic acid | 15.05 |
| water | 53.60 |
| viscosity = 300 cps/25° C./100 RPM #3 spindle | |

The above examples describe aqueous lubricant dispersions having a solids content of from 45% to 70% by weight. Since the prior art inability to use calcium stearate dispersions of greater than 55% by weight solids is a result of the high viscosities obtained, it can be seen that these high solids lubricants have useful viscosities with enhanced solids concentration. The result is a product which is flowable, pumpable and filterable, thus providing the same ease of handling as a 55% by weight calcium stearate dispersion.

Examples V through VIII describe coating compositions which have been prepared in part using the increased solids lubricant dispersions of this invention. In these examples, all parts by weight of the components which are introduced with water are reported on a solids basis. Total water present in each example is reported.

Examples V through VIII were prepared according to the following general procedure.

Pre-dispersed, spray dried clay was dispersed in water at 70% by weight total solids. Oxidized starch was slurried in tap water at ambient temperature in a jacketed vessel and cooked at 190° F. for 30 minutes. The cooked starch was then blended with the clay slurry under agitation supplied by a high speed laboratory stirrer. The carboxylated styrene-butadiene (SB) latex (50% by weight solids) and the high solids lubricant composition of this invention were added and total coating solids adjusted with tap water to 62% by weight of total.

EXAMPLE V

| component | parts by weight |
|---|---|
| clay (60/40 delaminated clay/#2 clay) | 100 |
| starch (oxidized corn starch) | 8 |
| carboxylated SB latex (DOW 620) | 8 |
| lubricant solids of Example I | 1.0 |
| total water | 71.7 |

EXAMPLE VI

| component | parts by weight |
|---|---|
| clay (60/40 delaminated clay/#2 clay) | 100 |
| starch (oxidized corn starch) | 8 |
| carboxylated SB latex (DOW 620) | 8 |
| lubricant solids of Example II | 1.0 |
| total water | 71.7 |

EXAMPLE VII

| component | parts by weight |
|---|---|
| clay (60/40 delaminated clay/#2 clay) | 100 |
| starch (oxidized corn starch) | 8 |
| carboxylated SB latex (DOW 620) | 8 |
| lubricant solids of Example III | 1.0 |
| total water | 71.7 |

EXAMPLE VIII

| component | parts by weight |
|---|---|
| clay (60/40 delaminated clay/#2 clay) | 100 |
| starch (oxidized corn starch) | 8 |
| carboxylated SB latex (DOW 620) | 8 |
| lubricant solids of Example IV | 1.0 |
| total water | 71.7 |

The paper coating compositions of Examples V through VIII were evaluated in a pilot plant coating trial using a cylindrical laboratory coater at coating speeds of about 3,000 feet per minute. The paper substrate was 27 lb/3300 ft.$^2$ Groundwood Lightweight paper. Coated sheets were supercalendered at 30 pounds per linear inch. The resulting coatings were evaluated according to the following tests which are described below.

| Test | Procedure |
|---|---|
| Gloss | TAPPI Method No. T 480 OS-78 |
| Brightness | Use a GE optical brightness meter according to TAPPI Method No. T 452 OS-77 |
| Opacity | TAPPI Method T 425 OM-86 |
| I.G.T. Pick | Use I.G.T. printability tester according to TAPPI Method No. T 499 SU-64 |

The data are set forth in Table I below.

TABLE I

| Coating | Viscosity Brookfield at 100 RPM (cps)/100° F. | Coated oneside Finished Wt. (lbs/ 300 sq. ft.) | loss | Opacity | Brightness | I.G.T. Pick (Kp-CM/Sec) |
|---|---|---|---|---|---|---|
| control* | 1880 | 32 | 50.0 | 67.6 | 81.2 | 111.7 |
| Ex. V | 1500 | 32 | 50.8 | 67.4 | 81.6 | 116.3 |
| Ex. VI | 1540 | 32 | 1.7 | 67.3 | 80.9 | 110.9 |
| Ex. VII | 1660 | 32 | 53.6 | 67.5 | 81.0 | 115.2 |
| Ex. VIII | 1360 | 32 | 55.0 | 67.7 | 81.4 | 118.2 |

*calcium stearate solids substituted for the solids content of the lubricants of this invention.

From the data of Table I, it is found that the lubricant dispersion of Example V provided a lesser viscosity increase in starch-based paper coating compositions and also increased the gloss and leveling properties of the paper sheet. The lubricant dispersions of Examples VI, VII, and VIII provided improved performance when the coated web was subjected to the typical paper finishing process of supercalendering whereby the properties of sheet gloss, sheet brightness and sheet opacity were increased. In addition, coater runnability was improved providing increased precision during coating application and metering when coating a rapidly moving web of paper or paper-board with a mineral-containing coating mixture.

While the invention has been described with reference to certain specific embodiments thereof, it is understood that it is not to be so limited since alterations and changes may be made therein which are within the full intended scope of the appended claims.

What is claimed is:

1. High solids dispersions in water having from about 45% by weight to about 75% by weight solids and from about 25% by weight to about 55% by weight water, the solids content comprising the following ratios:

| component | parts by weight |
|---|---|
| calcium stearate | 1.00 |
| at least one calcium stearate dispersing agent | about 0.01 to about 0.10 |
| block copolymer containing alkoxylated glycerine having a mol. wt. of about 3900 | about 0.05 to about 5.00 |
| urea | about 0.01 to about 1.00 |

2. The dispersions of claim 1 wherein said solids content is from about 50% by weight to about 75% by weight, and said water content is from about 25% by weight to about 50% by weight.

3. Paper and paperboard coating compositions containing water, pigment, binder and the solids of the composition of claim 1.

4. High solids dispersions in water having from about 45% by weight to about 75% by weight solids and from about 25% by weight to about 55% by weight water, the solids content comprising the following ratios:

| component | parts by weight |
|---|---|
| calcium stearate | 1.00 |
| glycerin polymer alkoxylated with ethylene oxide and/or propylene oxide having a mol. wt. of at least 2,000 | about 0.05 to about 5.00 |

5. The dispersions of claim 4 wherein said solids content is from about 50% by weight to about 75% by weight, and said water content is from about 25% by weight to about 50% by weight.

6. Paper and paperboard coating compositions containing water, pigment, binder and the solids of the composition of claim 4.

7. High solids dispersions in water having from about 45% by weight to about 75% by weight solids and from about 25% by weight to about 55% by weight water, the solids content comprising the following ratios:

| component | parts by weight |
|---|---|
| calcium stearate | 1.00 |
| sulfonated fatty acid ester | about 0.05 to about 5.00 |

8. The dispersions of claim 7 wherein said solids content is from about 50% by weight to about 75% by weight, and said water content is from about 25% by weight to about 50% by weight.

9. Paper and paperboard coating compositions containing water, pigment, binder and the solids of the composition of claim 7.

* * * * *

UNITED STATES PATENT AND TRADEMARK OFFICE

CERTIFICATE OF CORRECTION

PATENT NO. : 5,527,383

DATED : Jun. 18, 1996

INVENTOR(S) : Flynn, Gregory J.; Krasniewski, John M.; Wilson Jr., Joseph

It is certified that error appears in the above-indentified patent and that said Letters Patent is hereby corrected as shown below:

In col. 7, Table 1, column 3 heading, delete "300" and insert --3300--.

Signed and Sealed this

Fifteenth Day of October, 1996

Bruce Lehman

*Attest:*

BRUCE LEHMAN

*Attesting Officer*

*Commissioner of Patents and Trademarks*